US006872061B2

(12) United States Patent
Lemay et al.

(10) Patent No.: US 6,872,061 B2
(45) Date of Patent: Mar. 29, 2005

(54) METHOD FOR MAKING A MOINEAU STATOR AND RESULTING STATOR

(75) Inventors: Lionel Lemay, Clamart (FR); Jean-Pierre Chopard, Champforgueil (FR)

(73) Assignee: PCM Pompes (FR)

( * ) Notice: Subject to any disclaimer, the term of this patent is extended or adjusted under 35 U.S.C. 154(b) by 0 days.

(21) Appl. No.: 10/478,193

(22) PCT Filed: Jun. 14, 2002

(86) PCT No.: PCT/FR02/02052

§ 371 (c)(1),
(2), (4) Date: Nov. 18, 2003

(87) PCT Pub. No.: WO03/008807

PCT Pub. Date: Jan. 30, 2003

(65) Prior Publication Data

US 2004/0126257 A1 Jul. 1, 2004

(30) Foreign Application Priority Data

Jun. 21, 2001 (FR) ..... 01 08189

(51) Int. Cl.[7] ..... F01C 1/10

(52) U.S. Cl. ..... 418/48; 418/179; 418/1; 72/276; 29/888.02

(58) Field of Search ..... 418/48, 179, 1; 29/888.023, 888.02, 421.1; 72/276, 278, 283

(56) References Cited

U.S. PATENT DOCUMENTS

| | | | | | |
|---|---|---|---|---|---|
| 3,139,035 | A | * | 6/1964 | O'Connor | 418/1 |
| 3,457,762 | A | * | 7/1969 | Gain | 72/370.19 |
| 4,273,521 | A | * | 6/1981 | Baker et al. | 418/48 |
| 6,162,032 | A | * | 12/2000 | Jager | 418/48 |
| 6,241,494 | B1 | | 6/2001 | Pafitis et al. | |
| 6,497,030 | B1 | * | 12/2002 | Marando | 29/421.1 |
| 6,568,076 | B2 | * | 5/2003 | Bottos et al. | 29/888.023 |

FOREIGN PATENT DOCUMENTS

| | | | | |
|---|---|---|---|---|
| AU | 491586 | | 7/1976 | |
| EP | 0003676 | * | 8/1979 | 418/48 |
| FR | 2756018 | | 5/1998 | |
| FR | 2794498 | | 12/2000 | |

* cited by examiner

*Primary Examiner*—Theresa Trieu
(74) *Attorney, Agent, or Firm*—Dean W. Russell; Kilpatrick Stockton LLP

(57) ABSTRACT

The invention concerns a Moineau type gear pump stator (1), comprising a stator cavity with global axial extension inside an elongated body, characterised in that the stator cavity is defined by a rigid-walled metal tubular element (3) having internall the shape and dimensions of the stator cavity such that, when it is assembled with a rotor, a positive clearance with the rotor is obtained.

12 Claims, 7 Drawing Sheets

METHOD FOR MAKING A MOINEAU STATOR AND RESULTING STATOR

CROSS-REFERENCE TO RELATED APPLICATIONS

This application is the U.S. national phase of International Application No. PCT/FR02/02052 filed on Jun. 14, 2002, which application claims priority to French Application No. 01 08189 filed on Jun. 21, 2001, the contents of which are incorporated herein by reference.

FIELD OF THE INVENTION

The present invention falls within the field of Moineau-type gear pumps, also known as progressive cavity pumps, and it relates more especially to improvements made to the manufacture and structure of the stators of such pumps, these stators comprising a stator cavity of helical shape running axially overall inside an elongate body.

DESCRIPTION OF THE PRIOR ART

Given the highly complex shape of the stator cavity of this type of pump, the stator is usually made of a molded elastomer enclosed inside a rigid housing. Such an arrangement is satisfactory in many applications for which the temperature of the product to be displaced is below a 140° C., the maximum temperature that the elastomer can withstand without being damaged, and for which also the product to be displaced is chemically compatible with the elastomer.

By contrast, stators thus formed are not suitable in particular:

- if the temperature of the product to be displaced is above 140° C., which is the case for example in oil operations where the extraction of thick products entails their prior softening by injecting steam at temperatures of the order of 200 to 250° C.,
- if the product to be displaced is not chemically inert with respect to the elastomer (acidic products or solvents for example),
- in food plants where the parts in contact with the product have to be made of inert metal (for example of stainless steel),
- if the products circulating through the pump in succession have very different respective temperatures (operation from very low to very high temperature with the same pump hydraulics; the cleaning phase in place in food plants; sanitizing using steam).

Admittedly, attempts have already been made at manufacturing metal stators so as to overcome the aforementioned disadvantages. However, these have been solid metal stators, of which the cavity of complex shape has been excavated from a block of metal using highly complex and slow machining methods. These manufacturing exercises have proved to be very expensive, which means that solid metal stators have never been widely used on an industrial scale and have remained at an almost prototype stage (in the food industry in particular).

Now, only the use of metal stator cavities will make it possible to overcome the aforementioned disadvantages in various spheres of industry, provided, of course, that the cost of such metal-cavity stators is not prohibitive.

This is particularly the case with Moineau pumps arranged according to the teachings of document FR 2 756 018, which pumps are intended for deep-well oil extraction in a high-temperature environment demanding that the rotor and the stator, both made of metal, be constructed in such a way that an approximately constant positive clearance be maintained between them over a wide temperature range of as much as about 300° C.

Admittedly, document FR-A-2 794 498 discloses a structure of, and method of manufacturing of a, Moineau pump stator in which the stator cavity consists of a tubular element which may be made of metal. However, from a structural viewpoint, this known stator is of composite type: the tubular metal element defining the stator cavity is joined to an outer housing via an elastic material (such as an elastomer) filling the annular gap between the tubular metal element and the housing; what is more, the tubular element is oversized so that, under the action of the elastic filling material, it presses against and/or maintains stress on, the pump rotor.

A stator formed in this way restricts the field of use of the pump, firstly because of the clamping of the rotor by the stator (which excludes pumps for abrasive or highly viscous products—such as heavy crude oils-) and secondly, because of the presence of the filling material such as an elastomer (which excludes pumps intended to operate in high-temperature environments—such as pumps for extracting crude oil from deep wells-).

What is more, the presence of three main constituent parts (tubular element forming the stator cavity, housing, filling material) leads to a relatively high cost.

As far as the method of manufacture of this known stator is now concerned, this consists in placing a tubular metal portion, with a core introduced inside it, into a housing; then in applying pressure to the outside of the tubular metal portion so as to deform it to cause it to take on the shape of the core, it being possible for said pressure to originate from a pressurized fluid introduced into the annular space between the tubular portion and the housing; and finally, in withdrawing the mandrel and filling the annular space between the tubular element forming the stator cavity and the housing with an elastic material tailored so that said tubular element presses on and/or maintains stress on the rotor.

Such a method presents or introduces several disadvantages which, here again, limit the field of use of pumps equipped with the stators obtained.

A first disadvantage lies in the fact that the process of deforming, particularly via a hydraulic route, the initial tubular portion is conducted inside the housing of the stator, which then acts as a pressure chamber. It is then necessary to overengineer the housing so that it can mechanically withstand the forming pressures, even though thereafter this overengineering becomes needless when the pump is in operation.

Conversely, if one wishes to avoid excessive (and subsequently needless) overengineering of the housing, it is necessary to limit the forming pressures. This entails that the known process be limited to the deformation of tubular portions with fairly small wall thicknesses, leading to tubular elements forming stator cavities that have relative deformability. This deformability is exploited in the type of pump at which the document considered is aimed because the stator elastically grips the rotor. However, in other types of pump where a clearance that needs to be kept as constant as possible is required between the stator and the rotor, such deformability would constitute a prohibitive handicap.

It is also, in part, to regulate this deformability of the tubular metal element that it is necessary to envisage the addition of an elastic filler material providing continuous support, over its entire length, for the tubular element.

Finally, given the complex shape of the tubular metal element finally obtained by this process of forming under pressure, particularly hydraulic pressure, it is necessary to emphasize that the radial deformation of the initial tubular portion is not homogeneous and varies considerably with the location. As a result, the forming of the tubular metal element forming the stator cavity directly, and in a single pass from the tubular portion that is initially cylindrical of revolution, here again limits this process to the processing of parts with fairly small wall thicknesses.

SUMMARY OF THE INVENTION

It is therefore an object of the invention to simultaneously remedy the various disadvantages listed hereinabove and to propose improvements to the manufacture and structure of Moineau pump stators which are able to satisfy the various requirements of practical life, particularly as regards the rigidity of the stator cavity, the structural simplicity of the stator and the performing of the manufacturing process.

To these ends, according to a first of its aspects, the invention proposes an original method for manufacturing a stator of a Moineau-type gear pump, this stator comprising a stator cavity running axially overall inside an elongate body, the method consisting in manufacturing said stator cavity forming rigid-walled metal tube that is cylindrical of revolution, which the method, being in accordance with the invention, is characterized in that it comprises the following steps:

- a preliminary mechanical-forming step during which said metal tube that is cylindrical of revolution is deformed so as to preform a rough form that internally approximates to the shape and dimensions of the desired stator cavity,
- then a definitive-forming step during which said rough form is subjected to a hydroforming process, performed inside a hydroforming chamber, on a molding form to obtain a rigid tubular metal element forming a stator cavity having its shape and its exact interior dimensions such that once the stator has been assembled with a rotor, a positive clearance with the rotor is defined,
- and finally a step of mounting the tubular metal element that forms the stator cavity inside an outer casing forming a housing, with at least the ends of the tubular metal element being joined to said casing.

By virtue of the implementation of the method according to the invention, it is possible to produce a tubular metal element forming a stator cavity which has a wall of relatively great thickness and which, as a result, is perfectly rigid and self supporting: this tubular element can be joined to the housing only by its ends, hence greatly simplifying the assembly and allowing a lower cost, and one can be sure of maintaining the clearance between the rotor and the stator along the entire length of the pump.

In spite of the relative thickness of the initial tube (for example of the order of 3.5 mm for a diameter of the order of 65 mm), it is possible to obtain a tubular element that meets all the necessary requirements, in spite of the individual insufficiencies of the process used: the preliminary mechanical forming makes it possible to introduce significant local radial deformations in spite of the appreciable thickness of the wall that is to be formed, but without it being possible to achieve good precision on shape; by contrast, the process of hydroforming under very high pressure (for example of the order of $4000\times10^5$ Pa) makes it possible to achieve precise forming on the core, but on the condition that the amplitude of the localized radial deformation is relatively small.

The combination of the two processes of mechanical deformation and of hydroforming, conducted in two successive steps, makes it possible to reap their individual advantages and set aside their disadvantages, and therefore to succeed in manufacturing, under economical conditions, a stator with a cavity made of metal that can be used in forming Moineau pumps able to operate under arduous conditions.

In one possible embodiment, the preforming step leading to the rough form is performed in successive passes by successive external crushings of the metal tube between opposing jaws, the metal tube and the jaws being moved relative to one another in successive steps, axially and in terms of rotation.

In another embodiment, which is preferred, the preforming step leading to the rough form is performed by moving relative to each other the metal tube and at least two press rollers, it being possible in particular for said metal tube to be rotated about its axis while the two rollers, pressed against the tube in a diametrically opposed fashion, are moved parallel to the axis of said tube.

As to the fundamental final step involving the hydroforming process, this may be performed by compressing the rough form onto a core placed inside it, which leads to the transfer, by direct contact with the outer surface of the core and the inner surface of the rough form, of the exact shape and the precise dimensions from the core to the stator cavity; alternatively, it may be performed by expanding the rough form inside a mold, something which entails good control over the deformation of the metal and good control over its thickness so that the shaping of the outer face of the tubular element in contact with the mold results, on its inner face, in exact shaping and precise sizing of the stator cavity.

Once the tubular metal element that forms the stator cavity has been manufactured, this element is introduced into a cylindrical tubular casing, and the ends of the tubular stator cavity are joined to said casing; then the annular space between the stator cavity and the casing is possibly filled with a rigid filler material able to relieve the fixing members in the presence of vibration.

For applications to high-pressure pumps which require long stators, at least two stator portions are manufactured individually as explained hereinabove and are joined together end to end, particularly by screwing or welding.

According to a second of its aspects, the invention proposes a stator of a Moineau-type gear pump, comprising a stator cavity running axially overall inside an elongate body, characterized in that the stator cavity is defined by a rigid-walled tubular metal element internally having the shape and dimensions of the stator cavity such that, when the stator is assembled with a rotor, a positive clearance is defined with the rotor, and obtained by implementing the method and this tubular element is joined to an outer housing using rigid rings forming wedging spacer pieces which are inserted between the ends of said tubular metal element forming the stator cavity, and the outer housing.

These rings form fixing flanges for securing the stator to the adjacent elements upstream and down; in addition, in the event that an outer housing is present, these rigid rings form wedging spacer pieces inserted between the ends of said tubular metal element forming the stator cavity and of the outer housing. The connecting of the rings to the tubular metal element that forms the stator cavity and, where appropriate, to the outer housing, may be performed in any appropriate way, particularly by welding and/or screwing.

According to the anticipated applications of the pump, the annular gap defined between the tubular metal element forming the stator cavity and the housing may be filled with a rigid filler material, for example a thermosetting resin or a cement, able to enhance the resistance to vibration of the means that join the tubular element and the housing together.

By virtue of the provisions of the invention, the stator is formed with a stator cavity with rigid metal walls which is therefore able to meet the specific requirements of various users whereas, since the stator cavity is no longer hollowed out from a solid metal body, there is no longer any need, in order to manufacture it, to resort to expensive facilities and far simpler and less expensive technological solutions can be used to do this, one particularly effective example of which will be given later on.

Where there is a desire to have a long stator (high-pressure pump), such a stator may be formed by joining together, end to end, at least two stator portions produced individually as indicated hereinabove.

By virtue of all the provisions of the invention, it is possible to obtain Moineau pump stators with metal stator cavities (for example made of bronze of type UE9 or similar or made of stainless steel of type 316L or similar) which satisfy the aspirations of at least certain users, it being possible for such stators to be mass-produced under advantageous economic conditions.

BRIEF DESCRIPTION OF THE DRAWINGS

The invention will be better understood on reading the detailed description which follows of certain embodiments which are given solely by way of nonlimiting example.

In this description, reference is made to the attached drawings in which.

DETAILED DESCRIPTION OF THE INVENTION

Figure 1:
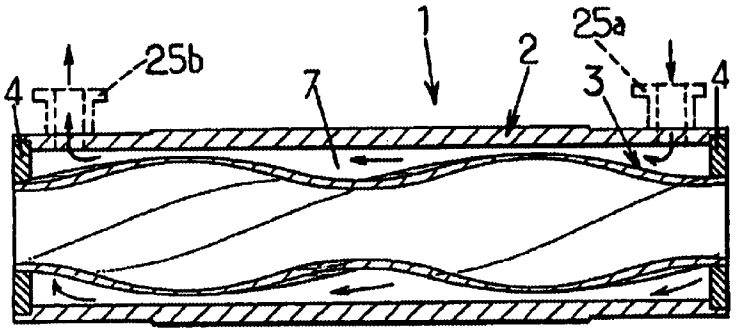
FIG. 1 is a simplified view in longitudinal section of one possible embodiment of a stator produced according to the invention.

Referring first of all to FIG. 1, one possible embodiment of a stator for a Moineau pump, denoted in its entirety by the reference 1, comprises a rigid outer casing or housing 2, of elongate shape and of tubular overall shape, inside which there is fixed a rigid-walled tubular metal element 3 which internally has the shape and dimensions of the desired stator cavity.

Figure 6:
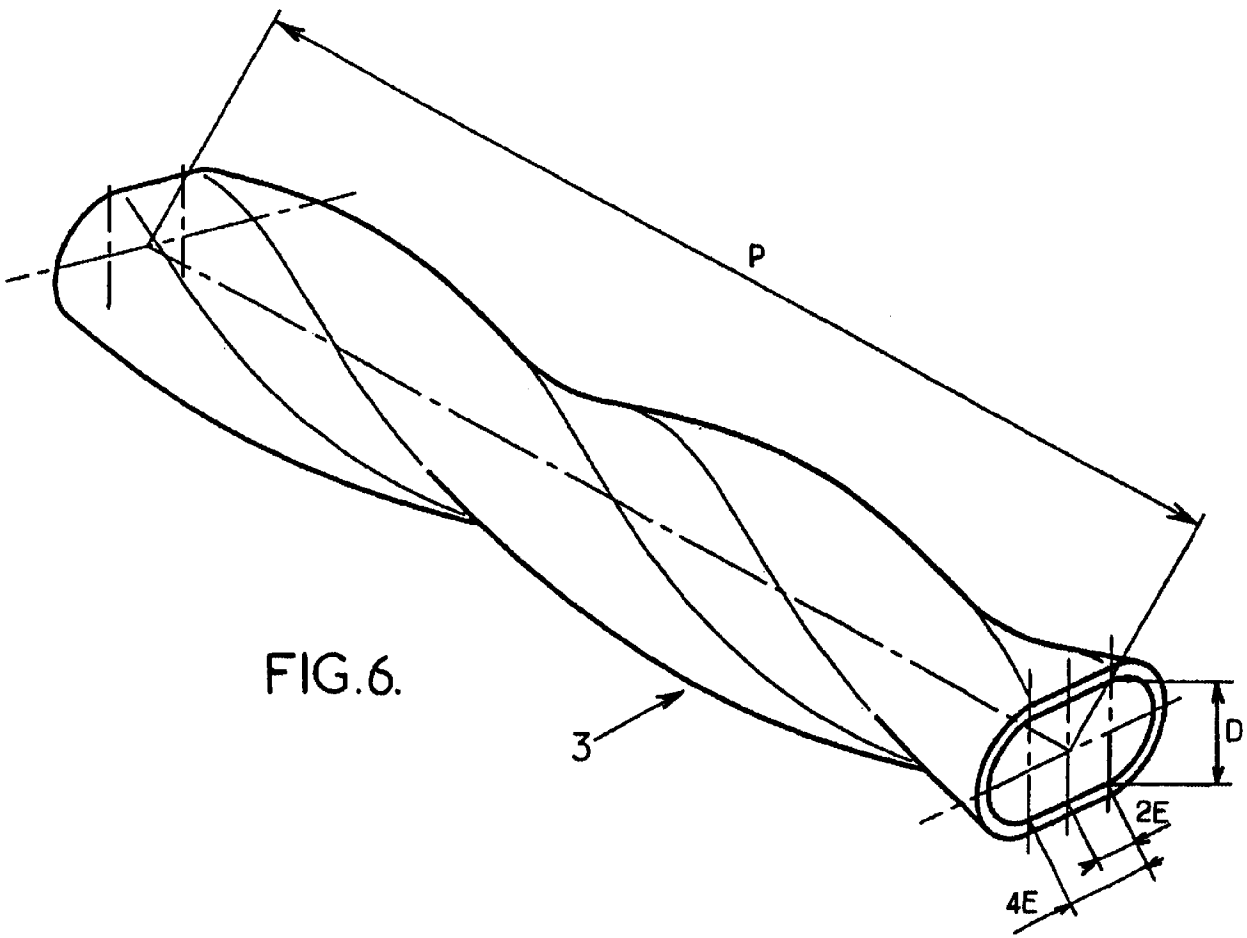
FIG. 6 is a perspective view of a tubular metal element forming a stator cavity according to the invention.

An enlarged perspective view of the element 3 is given in FIG. 6, which gives a more precise depiction of the Moineau profile, namely a helical gear of almost elliptical cross section. In FIG. 6, the element 3 is illustrated over a length limited to one pitch P of the helical winding; D denotes the nominal diameter of the tubular element 3, and E denotes the eccentricity.

The tubular element 3 forming the stator cavity is made of any metal suited to its mechanical construction and to the application for which the pump is intended; the choice of material must in particular be such that the metal stator cavity and the metal rotor contained therein be made of respective metallic materials that have coefficients of thermal expansion that are compatible so that any dimensional variation of one is accompanied by a dimensional variation of the other that is roughly identical, in terms of amplitude and in terms of direction, so that an approximately constant positive clearance is maintained over a wide temperature range that may be as much as 300° C. in the case of deep well oil extraction pumps (on this point, please refer to document FR-A-2 756 018); likewise, for food applications, the metal material of the stator cavity needs to be inert with respect to the product; the same is true for example for the pumping of acidic or basic products.

It may be possible, for example, to make the tubular element 3 that forms the stator cavity out of bronze of type UE9 or equivalent; or alternatively out of stainless steel of type 316L or equivalent.

As illustrated in FIG. 1 or in FIG. 6, the tubular element 3 has relatively thick walls, that is to say that the thickness of its wall represents a few percent (for example 6%) of its nominal diameter: the essential thing is for the thickness of this wall to be sufficient to give the tubular element 3 excellent rigidity.

Figure 4:
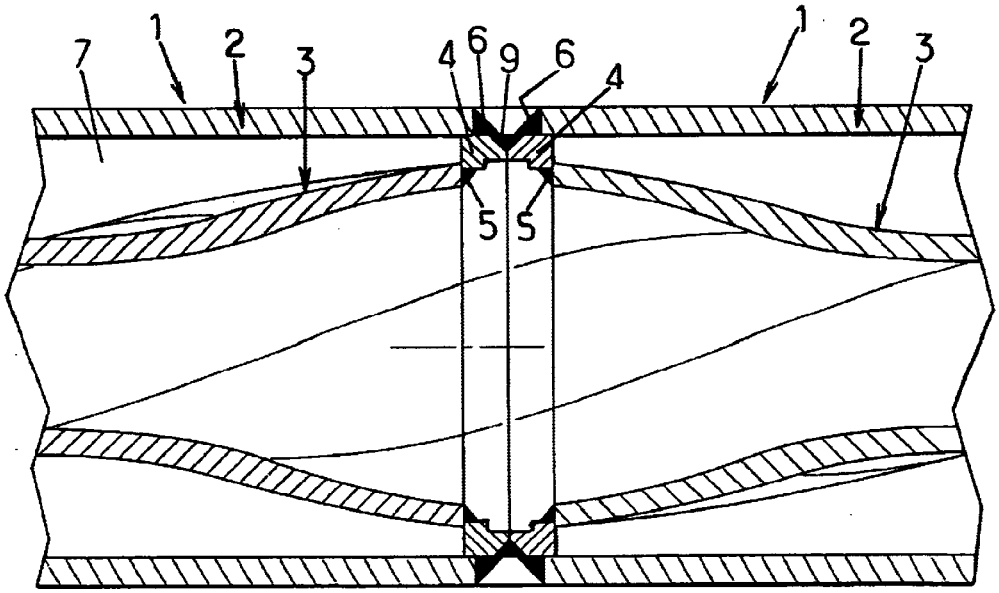
FIG. 4 is an enlarged view of part of the device of FIG. 3.

The tubular element 3 is secured to the outer housing in any appropriate way able to yield a rigid assembly of nondeformable axis. In the exemplary embodiment depicted in FIG. 1, wedging rings 4 are inserted between the respective ends of the tubular element 3 and of the housing and are fixed mechanically to these items, particularly by screwing or preferably by welding. Such assembly by welding is shown in the enlarged part view that is FIG. 4, in which 5 has been used schematically to depict the bead of welding that welds the ring 4 to the frontal end of the tubular element 3 and 6 has been used to depict the bead of welding that welds the ring 4 to the end of the housing 2 in which housing this ring is partially engaged.

If the tubular element 3 thus arranged does not have sufficient longitudinal rigidity, then it is necessary to provide one or more intermediate support(s) by fitting (an) intermediate wedging ring(s).

In certain applications of use of pumps equipped with a stator according to the invention, it may prove beneficial to take advantage of the presence of the empty gap between the housing and the tubular element to circulate a fluid therein for specific purposes. In particular, provision may be made for a hot fluid (steam, hot water, for example) to be circulated therein in order to heat—and therefore fluidize—a thick/pasty product displaced by the rotor so as to facilitate this displacement (or with thick crude oil pumped from a deep well for example). It is then appropriate for the housing to be equipped with axially distant orifices, one an inlet orifice 25*a* and the other an outlet orifice 25*b*, for this fluid, as indicated in dashed line in FIG. 1.

Figure 2:
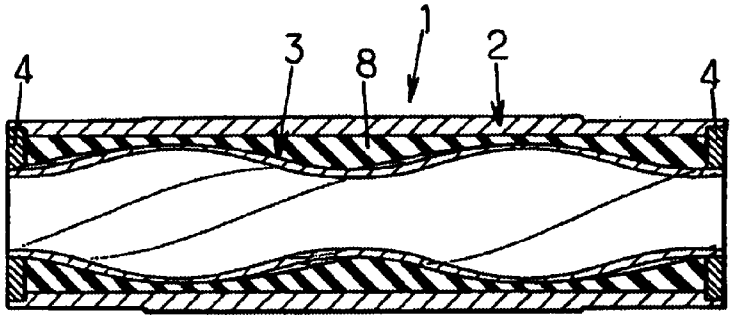
FIG. 2 is a simplified view in longitudinal section of another embodiment of the stator of FIG. 1.

It may also prove necessary to enhance the resistance to vibration of the assembly members and, for this purpose, recourse may be had to the solution illustrated in FIG. 2 which consists in filling the annular gap 7 between the tubular element 3 and the housing 2 with a rigid filler material 8 (for example a thermosetting resin, of cement, a cement ceramic, etc.): this results in an elimination, or at least in an attenuation, of the vibrations of this element 3.

Figure 3:
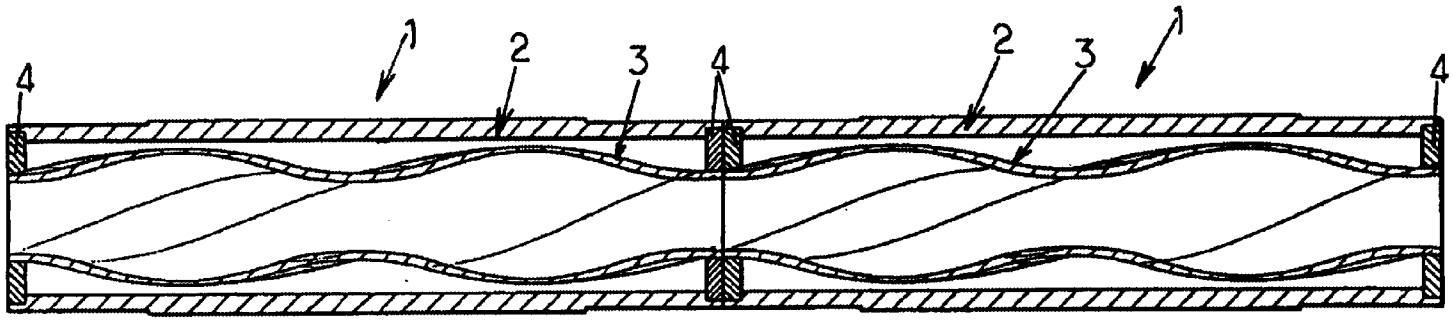
FIG. 3 is a simplified view in longitudinal section of a long stator, for a high-pressure pump, arranged according to the invention.

To form long stators (in a Moineau pump the delivery pressure is higher the higher the number of progressive cavities and therefore the longer the pump), several stator portions produced individually as indicated hereinabove may be mechanically joined together end to end. FIG. 3 depicts by way of example a long stator formed by joining together end to end two stators 1 like that of FIG. 1. The mechanical joining-together of the two stators 1 may be performed in any appropriate way, particularly by screwing or preferably by welding. In the enlarged view of the region of connection of the two stators 1, given in FIG. 4, 9 has been used to denote the bead of welding joining the two stators together end to end: for this, the end faces of the butting-together rings 4 are chamfered and the bead of welding 9 is deposited in the annular groove thus formed.

The arrangements which have just been explained with regard to FIGS. 2 and 3 may advantageously be combined to form long stators, for example such as those used in pumps for extracting crude oil (which may, for example, have lengths of the order of 9 meters).

Figure 5:
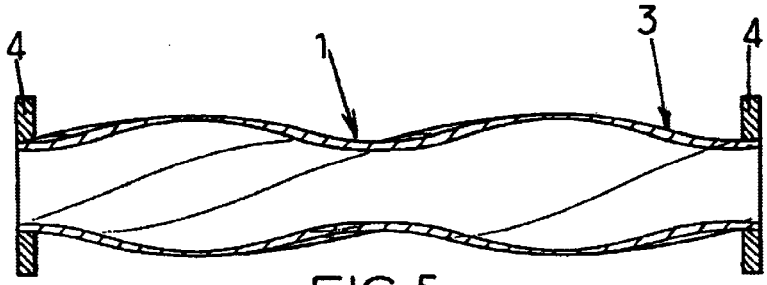
FIG. 5 is a simplified view in longitudinal section of yet another embodiment of a stator produced according to the invention.

The short stators, the tubular metal element 3 forming the stator cavity may, on its own, have enough rigidity and the presence of a housing 2 becomes superfluous. As illustrated in FIG. 5, the stator 1 is then made up solely of the tubular element 3.

In this case, to facilitate the joining of said tubular element 3 to adjacent elements upstream and down, it is desirable to anticipate the presence of the aforesaid rings 4, joined (welded or screwed in particular) to the ends of the tubular element 3 and to the outside thereof, said rings then constituting assembly flanges.

The tubular metal element 3 may be manufactured by any appropriate means. However, its complex overall shape and the dimensional precision and the quality of the surface finish required for its internal face which, strictly speaking, constitutes the stator surface, means that conventional means are too expensive and/or too lengthy to perform to allow industrial scale manufacture.

It is in order to overcome this difficulty that the invention recommends an original method which will now be explained.

The starting point is a tubular metal portion that is cylindrical of revolution, made of the desired metal, with a rigid wall (for example the wall thickness of which may range up to about 6% of the outside diameter of the tube).

A preliminary preforming step is first of all performed, during which step the initial metal tube is mechanically deformed, so as to preform a tubular rough form which internally has approximately the shape and the dimensions of the desired stator cavity. The shape-wise and dimensional approximation may, for example, be of the order of 5%.

Figure 7A:
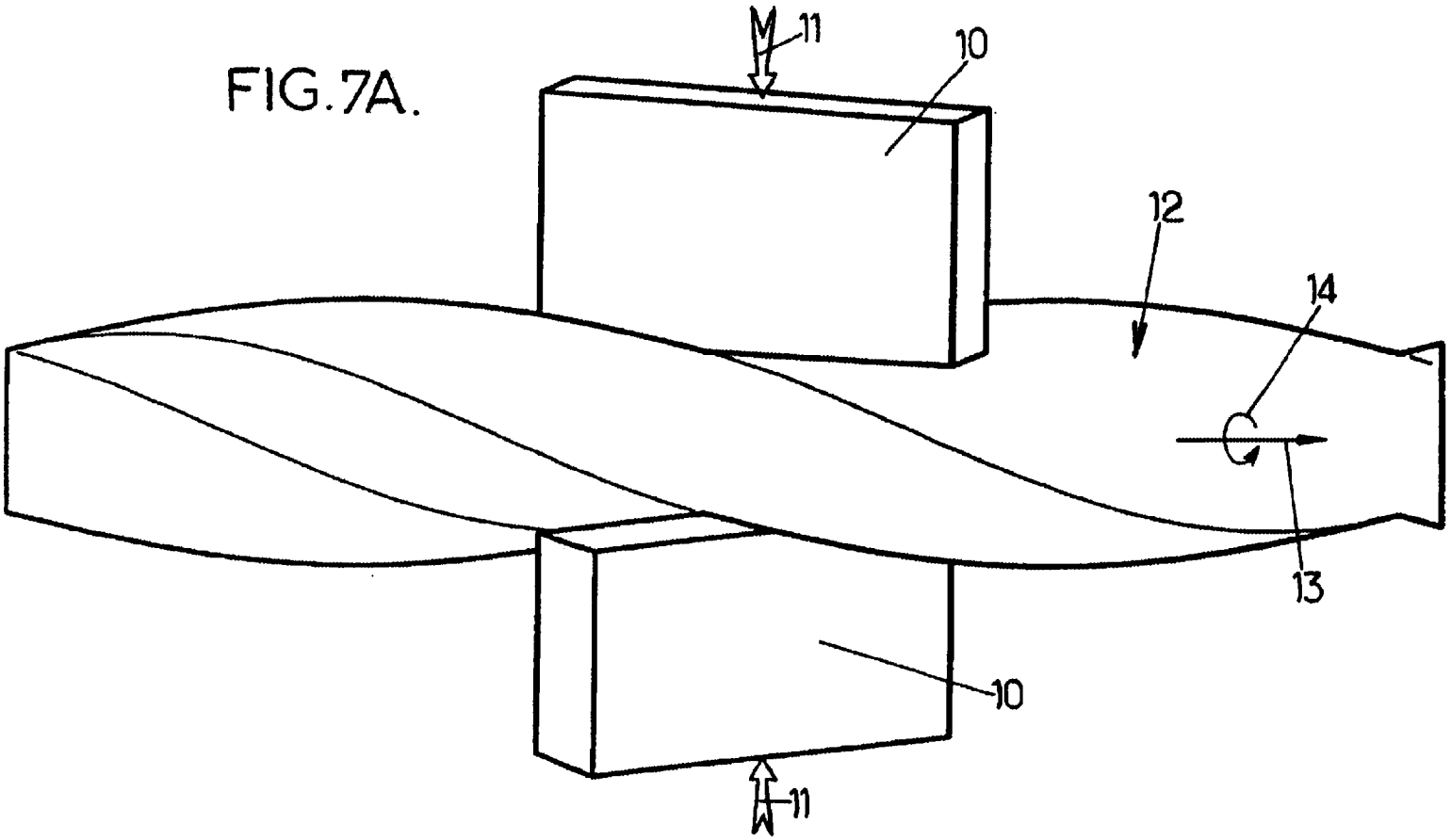
FIGS. 7*a* and 7*b* are schematic views respectively illustrating two methods for performing the step of preforming a tubular metal rough form according to the invention.

One solution for performing this preforming step consists in hammering the initial tube, as illustrated in FIG. 7*a*, by exerting diametrical pressure (arrows 11) on the tube 12 gripped between two jaws 10 secured to a press. The jaws 10 are shaped and arranged with respect to each other (for example angularly offset from one another) in such a way as to indent the tube to form the indentations or "valleys" of the helical windings. As the jaws 10 produce localized deformations, it is necessary to proceed in successive passes along the tube which is moved, step by step axially (arrow 13) and rotationally (arrow 14) simultaneously, so as to follow the profile of the Moineau helix.

Figure 7B:
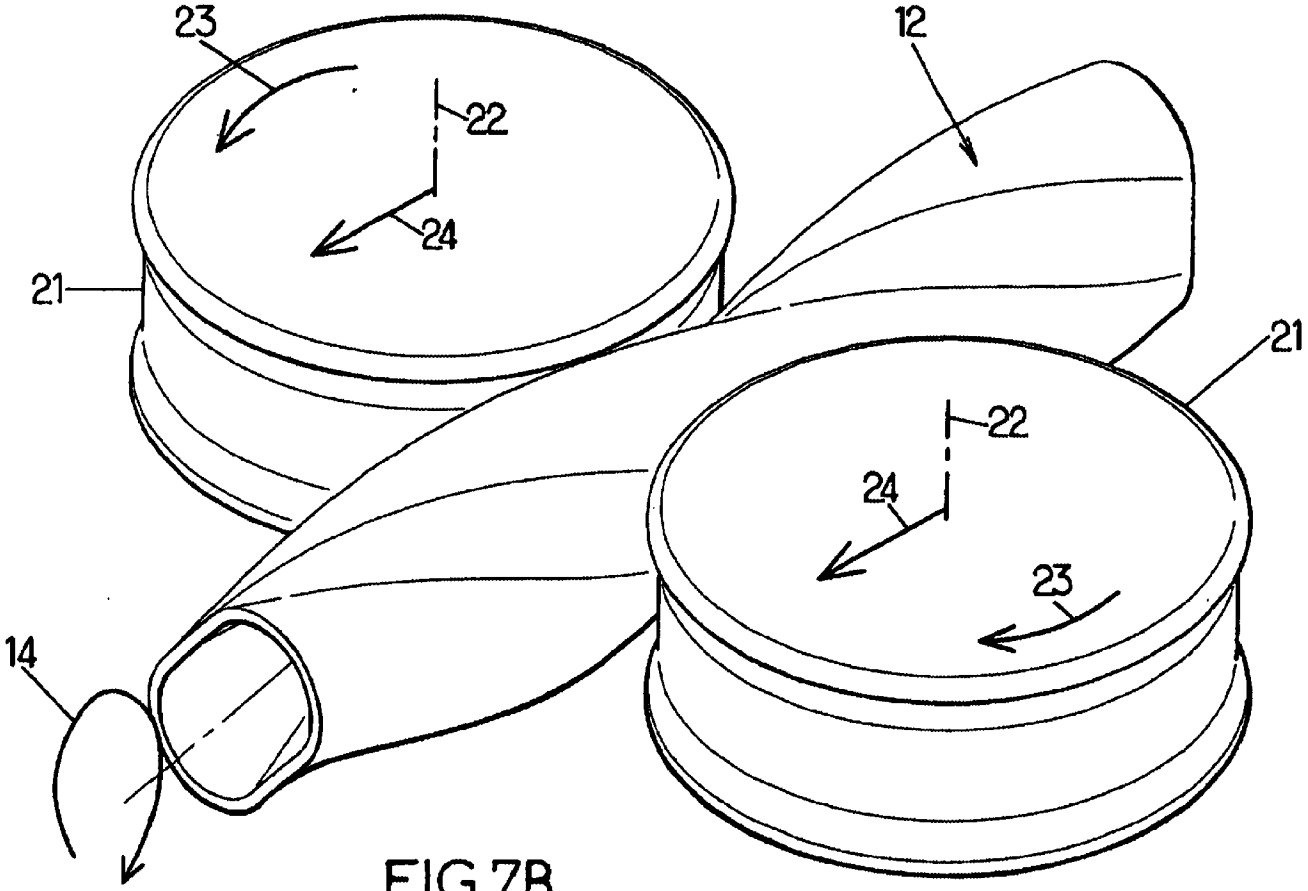

Another solution currently preferred consists in deforming the tube between at least two rotary rollers, as illustrated in FIG. 7*b*. As in the previous solution, the tube 12 is rotated about its axis (arrow 14). At the same time, several rollers 21 (in practice two diametrically opposed rollers 21) are pressed toward one another so as to locally crush the tube between them: at the same time as the tube rotates on itself, the two rollers 21 rotate about their respective axes 22 (arrows 23) and a relative axial displacement is generated between the tube 12 and the set of rollers 21. In the example illustrated in FIG. 7*b*, the rotating tube is not axially displaced, whereas it is the set of rotating rollers 21 which is displaced (arrows 24) parallel to the axis of the tube.

Once the rough form has been prepared, the final step of definitive shaping of the rough form 12 is performed so as to obtain the tubular element 3 that forms the stator cavity. According to the invention, this definitive forming is performed using a hydroforming process, that is to say that one of the faces (inner or outer) of the rough form 12 is subjected to a hydraulic pressure which, given the rigidity of the metal wall, needs to be high and which is exerted uniformly at every point of the surface, so that the wall of the rough form, in spite of its rigidity, is pressed against a reference cavity or impression that it closely follows and the exact dimensions and shape of which it maintains.

Figure 8:
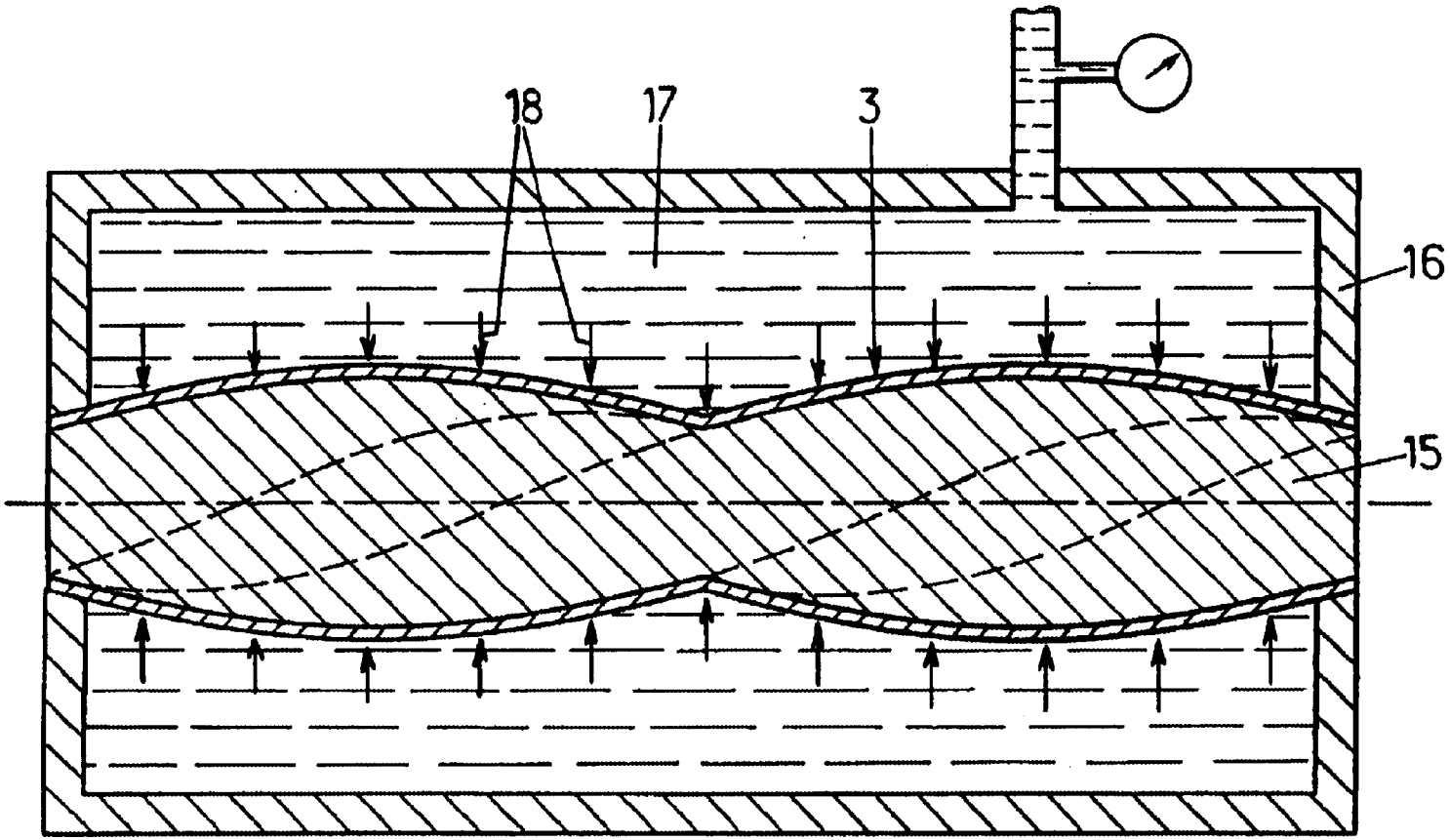
FIG. 8 is a schematic view illustrating a first method of performing the step of hydroforming the tubular metal element forming the stator cavity from the rough form preformed in the step illustrated in FIGS. 7*a* or 7*b*.

According to a first embodiment illustrated in FIG. 8, the rough form 12 is slipped over a core 15 which, externally, has the exact desired shaping for the stator cavity. The rough form/core assembly is placed in a closed chamber 16 (hydroforming chamber) that is filled with a liquid 17. By pressurizing this liquid, the rough form 12 is crushed (arrows 18) onto the core 15: this then constitutes the tubular metal element 3 the inner face of which is shaped exactly to the external shape of the core 15 (hydroforming by compression onto an internal core).

Figure 9:
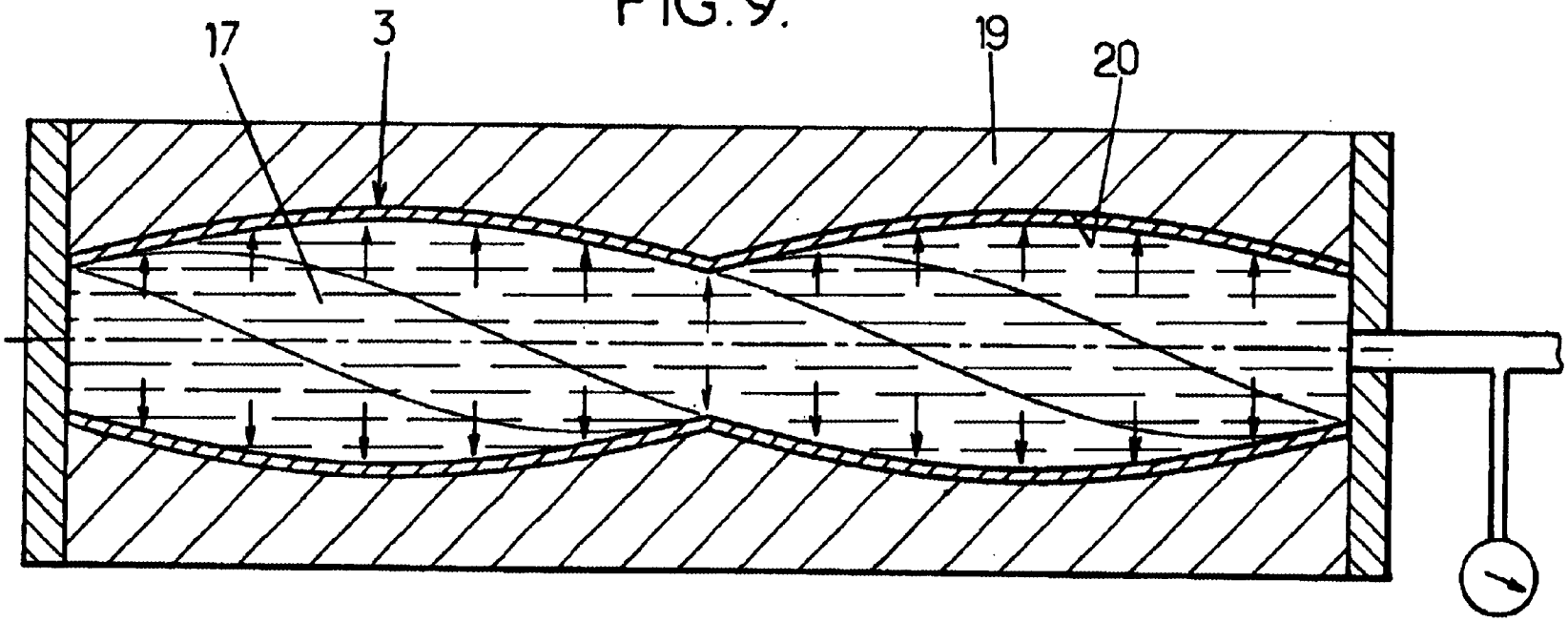
FIG. 9 is a schematic view illustrating a second method for performing the step of hydroforming the tubular metal element forming the stator cavity from the rough form preformed in the step illustrated in FIGS. 7*a* or 7*b*.

According to a second embodiment illustrated in FIG. 9, the rough form 12 is introduced into a mold 19 having a cavity 20 shaped to the exact shape to be given to the tubular element 3 that is to form the stator cavity. The ends of the rough form 12 are hermetically sealed and the interior volume of the rough form is filled with liquid 17. By pressurizing this liquid, the rough form 12 is crushed (arrows 18) against the wall of the molding cavity 20: this then constitutes the tubular element 3 (hydroforming by expansion against an external mold).

It will be noted that, in the process of hydroforming by compression onto an internal core, it is the interior face of the tubular element 3 (that is to say strictly speaking the face defining the stator cavity itself) which is brought into contact with the core and which directly and closely adopts the shape of the latter. By contrast, in the process of hydroforming by expansion against the wall of the molding cavity, it is the outer face of the tubular element 3 which is brought into direct and close contact with the molding wall, the shape of which it takes on: the internal face of the tubular element 3 does not faithfully reproduce this shape unless the wall thickness of the element 3 is perfectly controlled, in particular is perfectly uniform.

The hydroforming process may, for example, be carried out under the following conditions:

internal dimensions of the finished tubular metal element:

D=42.3 mm
D+4E=72.8 mm perimeter of the mean fiber of the element:
204.8 mm contraction during deformation by hydroforming:
about 5% diameter of the mean fiber of the initial tube:
68.44 mm inside diameter of the initial tube with a thickness of 3.5 mm: 65 mm.

The hydroforming process is performed using, by way of liquid medium, water raised to a pressure of the order of $4\times10^8$ Pa for about 10 minutes.

Once the tubular element 3 has been finished, the assembly of the stator is completed by joining this element 3 to the housing 2, for example using rings 4, particularly welded ones, and possibly filling the gap 7 between the element 3 and the housing 2, according to the indications given above in relation to FIGS. 1 to 4.

The method of manufacture of the element 3 according to the invention can be exploited on an industrial scale and allows industrial mass production of the tubular metal element 3 forming the stator cavity. The arrangements of the invention therefore make it possible to anticipate series production, at acceptable cost, of Moineau pumps equipped with a stator with a cavity made of metal able to meet the requirements in at least some fields of industry, particularly pumps in which a positive clearance between stator and rotor needs to be maintained.

What is claimed is:

1. A method for manufacturing a stator of a Moineau-type gear pump, this stator comprising a stator cavity running axially overall inside an elongate body, the method consisting in manufacturing said stator cavity from a rigid-walled metal tube that is cylindrical of revolution, the method comprising the following steps:

a preliminary mechanical-forming step during which said metal tube that is cylindrical of revolution is deformed so as to preform a rough form that internally is substantially helical in shape and approximates to the shape and dimensions of the desired stator cavity, then a definitive-forming step during which said rough form is subjected to a hydroforming process, performed inside a hydroforming chamber, on a molding form to obtain a tubular metal element forming a stator cavity with its shape and its exact interior dimensions such that once the stator has been assembled with a rotor, a positive clearance with the rotor is defined, and finally a step of mounting the tubular metal element that forms the stator cavity inside an outer casing forming a housing, with at least the ends of the tubular metal element being joined to said casing.

2. The method as claimed in claim 1, wherein the preforming step leading to the rough form is performed by successive external crushings of the metal tube between opposing jaws, the metal tube and the jaws being moved relative to one another in successive steps, axially and in terms of rotation.

3. The method as claimed in claim 1, wherein the preforming step leading to the rough form is performed by moving relative to each other the metal tube and at least two press rollers arranged symmetrically in contact with it.

4. The method as claimed in claim 3, wherein the metal tube is rotated about its axis and the rollers are moved parallel to the axis of the tube, at the same time being pressed forcibly against the tube.

5. The method as claimed in claim 1, wherein the hydroforming process is performed by compressing the rough form onto a core arranged inside it.

6. The method as claimed in claim 1, wherein the hydroforming process is performed by expanding the rough form placed inside a mold.

7. The method as claimed in claim 1, wherein an annular space between the tubular metal element and the outer casing is filled with a filler material.

8. The method as claimed in claim 1 for manufacturing a very long stator, wherein at least two stator portions are manufactured individually as claimed in claim 1 and wherein they are joined together end to end.

9. A stator of a Moineau-type gear pump, comprising a stator cavity running axially overall inside an elongate body, wherein the stator cavity is defined by a rigid-walled tubular metal element internally having the shape and dimensions of the stator cavity such that, when the stator is assembled with a rotor, a positive clearance is defined with the rotor, and which is obtained utilizing:

a preliminary mechanical-forming step during which said tubular metal element, which is cylindrical of revolution, is deformed so as to preform a rough form that internally approximates to the shape and dimensions of the stator cavity, then a definitive-forming step during which said rough form is subjected to a hydroforming process, performed inside a hydroforming chamber, on a molding form to obtain the tubular metal element forming a stator cavity with its shape and its exact interior dimensions such that once the stator has been assembled with a rotor, a positive clearance with the rotor is defined, and finally a stop of mounting the tubular metal element that forms the stator cavity inside an outer casing forming a housing, with at least the ends of the tubular metal element being joined to said casing, and wherein this tubular element is joined to the outer housing using rigid rings forming wedging spacer pieces which are inserted between the ends of said tubular metal element forming the stator cavity, and the outer housing.

10. The stator as claimed in claim 9, wherein the annular gap defined between the tubular metal element forming the stator cavity and the housing is filled with a filler material able to enhance the resistance to vibration of the means that join the tubular element and the housing together.

11. The stator as claimed in claim 9, wherein said stator is formed of at least two stator portions formed individually and joined together end to end.

12. The stator as claimed in claim 9, wherein the housing is provided with an inlet orifice and an outlet orifice which are axially distant from one another, for admitting and circulating fluid in the gap between the housing and the tubular metal element.

* * * * *